US010641461B2

(12) United States Patent
Shito

(10) Patent No.: US 10,641,461 B2
(45) Date of Patent: May 5, 2020

(54) LIGHT ILLUMINATING APPARATUS

(71) Applicant: HOYA CANDEO OPTRONICS CORPORATION, Toda-shi, Saitama (JP)

(72) Inventor: Kazutaka Shito, Toda (JP)

(73) Assignee: HOYA CANDEO OPTRONICS CORPORATION, Toda-Shi, Saitama (JP)

( * ) Notice: Subject to any disclaimer, the term of this patent is extended or adjusted under 35 U.S.C. 154(b) by 0 days.

(21) Appl. No.: 16/026,755

(22) Filed: Jul. 3, 2018

(65) Prior Publication Data

US 2019/0011112 A1 Jan. 10, 2019

(30) Foreign Application Priority Data

Jul. 7, 2017 (JP) ..... 2017-133882

(51) Int. Cl.

| | |
|---|---|
| ***F21V 7/06*** | (2006.01) |
| ***F21V 7/00*** | (2006.01) |
| ***B41M 5/00*** | (2006.01) |
| ***B41F 23/04*** | (2006.01) |
| *F21Y 115/10* | (2016.01) |
| *F21Y 103/10* | (2016.01) |
| *B41J 11/00* | (2006.01) |

(52) U.S. Cl.

CPC ..... *F21V 7/06* (2013.01); *B41F 23/0409* (2013.01); *B41F 23/0453* (2013.01); *B41M 5/0011* (2013.01); *F21V 7/005* (2013.01); *B41J 11/002* (2013.01); *F21Y 2103/10* (2016.08); *F21Y 2115/10* (2016.08)

(58) Field of Classification Search

USPC ..... 250/492.1

See application file for complete search history.

(56) References Cited

U.S. PATENT DOCUMENTS

| | | | | |
|---|---|---|---|---|
| 5,727,874 A * | 3/1998 | Yamamoto | ..... | F21S 41/337 362/305 |
| 5,876,114 A * | 3/1999 | Nino | ..... | F21S 41/334 362/518 |
| 7,070,312 B2 * | 7/2006 | Tatsukawa | ..... | F21V 7/0016 362/545 |

(Continued)

FOREIGN PATENT DOCUMENTS

JP 2016-164871 A 9/2016

*Primary Examiner* — Phillip A Johnston

(74) *Attorney, Agent, or Firm* — Rabin & Berdo, P.C.

(57) ABSTRACT

A light illuminating apparatus for irradiating light of a line shape extending in a first direction and having a predetermined line width in a second direction perpendicular to the first direction, includes a light emitting unit including a substrate, and a plurality of light sources arranged at a predetermined interval along the first direction on the substrate such that an optical axis is matched to a third direction perpendicular to the first and second directions, and a mirror unit having a mirror surface to reflect and focus the light. In a cross section of the mirror unit taken along a plane defined by the second direction and the third direction, a cross-sectional shape of the mirror surface is a curved shape resulting from rotation of each of a horizontal axis direction positive side part and a horizontal axis direction negative side part of a parabola $y=ax^2$.

18 Claims, 14 Drawing Sheets

(56) References Cited

U.S. PATENT DOCUMENTS 8,134,104 B2 * 3/2012 Finot ..... F24S 23/74
250/203.1
9,018,600 B2 * 4/2015 Stowell ..... B41J 11/002
250/492.1

* cited by examiner

LIGHT ILLUMINATING APPARATUS

TECHNICAL FIELD

The present disclosure relates to a light illuminating apparatus that irradiates light of a line shape.

BACKGROUND ART

Conventionally, a printer designed to perform a printing task by transferring an ink that is curable by irradiation of ultraviolet (UV) light to a target object such as paper is known. Such a printer is equipped with a UV light illuminating apparatus to cure the ink on the target object. In keeping with the demand for lower power consumption or longer service life, a UV light illuminating apparatus configured to use a Light Emitting Diode (LED) as an alternative to a traditional discharge lamp for a light source is proposed (for example, Patent Literature 1).

The light emitting apparatus disclosed in Patent Literature 1 is equipped with a light source unit having a plurality of light emitting elements arranged at a predetermined interval in lengthwise direction to emit light of a line shape, and a reflection unit having a reflective surface on the side facing the light source unit to reflect light from the light source unit. The reflective surface has a parabolic shape in cross section perpendicular to a direction in which the light source unit extends and is configured to emit light from the light source unit as a parallel light from the light emitting apparatus.

RELATED LITERATURES

Patent Literatures (Patent Literature 1) Japanese Patent Publication No. 2016-164871

Non-Patent Literatures

DISCLOSURE

Technical Problem

According to the light emitting apparatus disclosed in Patent Literature 1, it is possible to improve the irradiation intensity of ultraviolet (UV) light at a predetermined position on a target object, and allow for a uniform irradiation intensity distribution. However, a printer (for example, a sheet-fed offset printer), in which the UV light illuminating apparatus is mounted, performs a printing task on an target object to be illuminated with UV light, in many cases, a paper that is vulnerable to deformation, so the paper often flutters during conveyance. In the event that the target object is deformed, it fails to obtain desired irradiation intensity and irradiation intensity distribution on the target object, resulting in non-uniformity in the cured state of the ink.

In view of these circumstances, the present disclosure is directed to providing a light illuminating apparatus that can irradiate light of a line shape with predetermined irradiation intensity and irradiation intensity distribution within a predetermined working distance.

Technical Solution

To achieve the object, a light illuminating apparatus of the present disclosure is a light illuminating apparatus for irradiating, to a predetermined irradiation position on a reference irradiation surface, light of a line shape extending in a first direction and having a predetermined line width in a second direction perpendicular to the first direction, and includes a light emitting unit including a substrate, and a plurality of light sources arranged at a predetermined interval along the first direction on the substrate such that a direction of an optical axis is matched to a third direction perpendicular to the first direction and the second direction, and a mirror unit having a mirror surface to reflect and focus the light irradiated from the light emitting unit, wherein in a cross section of the mirror unit taken along a plane defined by the second direction and the third direction, a cross-sectional shape of the mirror surface is a curved shape resulting from rotation of each of a horizontal axis direction positive side part and a horizontal axis direction negative side part of a parabola $y=ax^2$ (a is coefficient) in coordinates where the second direction is a horizontal axis x and the third direction is a vertical axis y, around an origin at a same rotation angle θ toward the vertical axis.

By this configuration, within a predetermined range in a direction perpendicular to the irradiation surface, ultraviolet light emitted from the light emitting unit can be focused, and thus, desired irradiation intensity and irradiation intensity distribution is obtained within the predetermined range (within a predetermined working distance).

Additionally, preferably, the coefficient a of the parabola is 1-3.

Additionally, preferably, the rotation angle θ is 3-10°.

Additionally, preferably, the curved shape is also a shape resulting from movement of each of the horizontal axis direction positive side part and the horizontal axis direction negative side part of the parabola after the rotation to the vertical axis side along the horizontal axis.

Additionally, preferably, a movement distance of each of the horizontal axis positive side part and the horizontal axis negative side part of the parabola after the rotation to the vertical axis side is 0.5-4 mm.

Additionally, preferably, the light source is disposed at an offset position to a vertical axis positive side from the origin.

Additionally, preferably, an offset quantity of the light source from the origin is 3-7 mm.

Additionally, preferably, the light emitting unit has an encapsulation lens disposed on the substrate, covering each light source.

Additionally, preferably, the light is light of a wavelength that acts on an ultraviolet curable resin.

Advantageous Effects

As described above, according to the light illuminating apparatus of the present disclosure, it is possible to irradiate light of a line shape with predetermined irradiation intensity and irradiation intensity distribution within a predetermined working distance.

BEST MODE

Figure 1A:
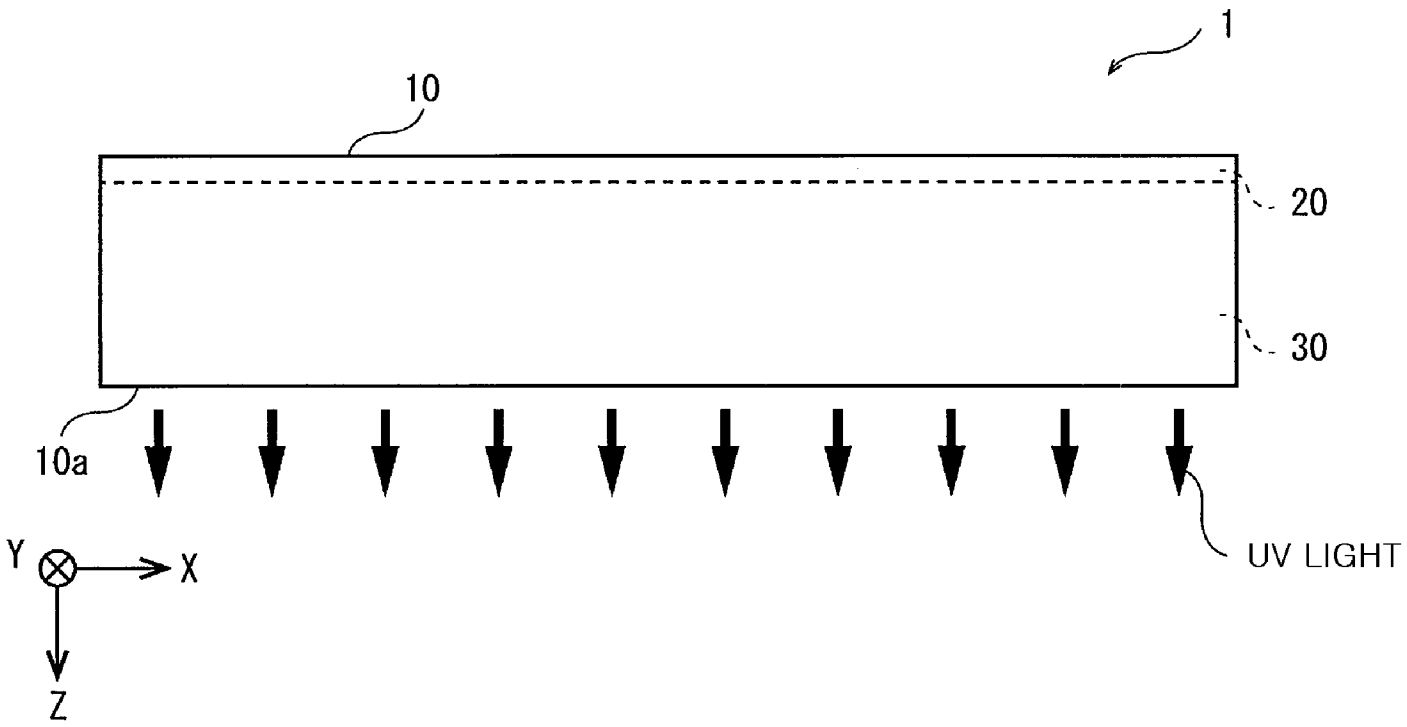
FIG. 1A, FIG. 1B, and FIG. 1C are diagrams showing an outward appearance of a light illuminating apparatus according to a first embodiment of the present disclosure.

Hereinafter, the embodiments of the present disclosure will be described in detail with reference to the accompanying drawings. Furthermore, in the drawings, the same or equivalent elements are assigned with the same reference numerals, and its description is not repeated herein.

(First Embodiment)

Figure 1B:
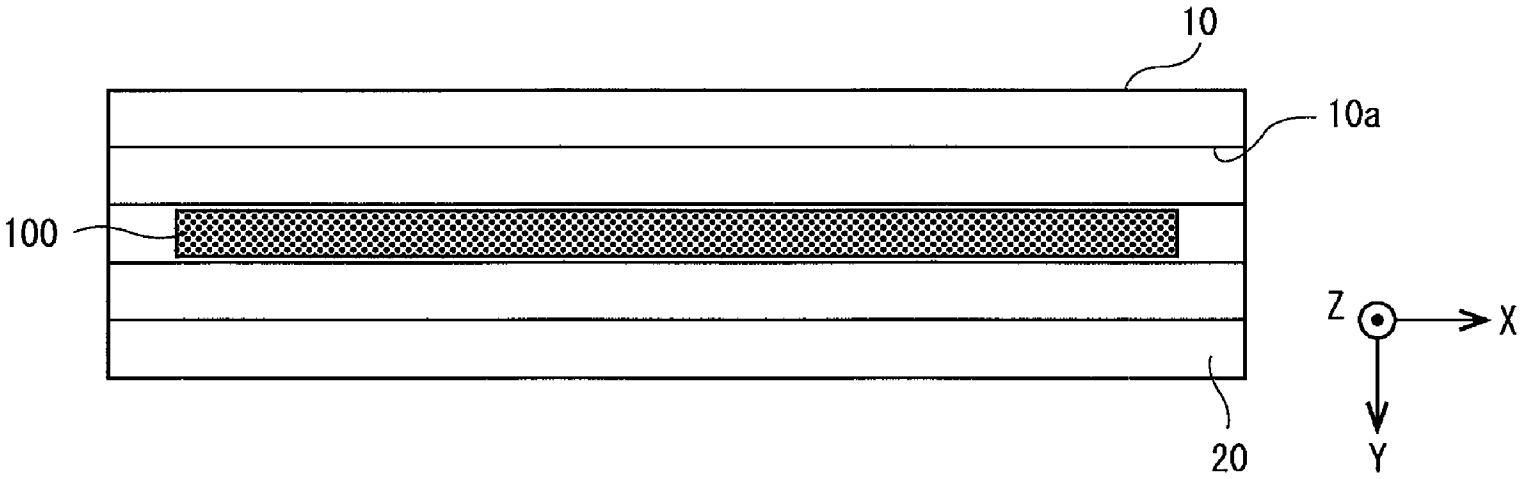
Figure 1C:
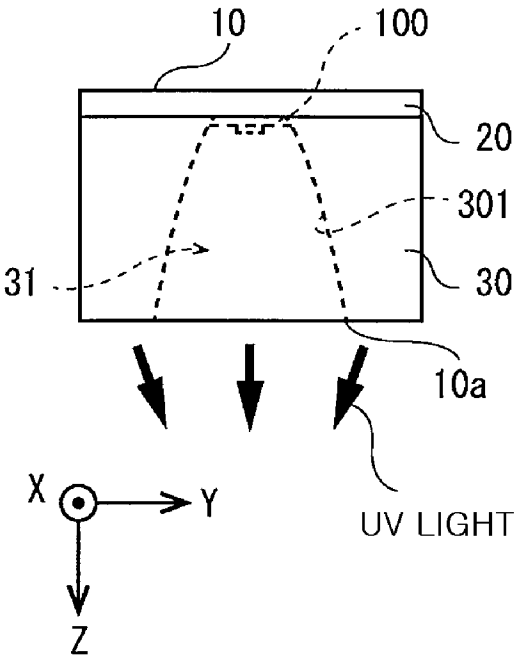
Figure 4B:
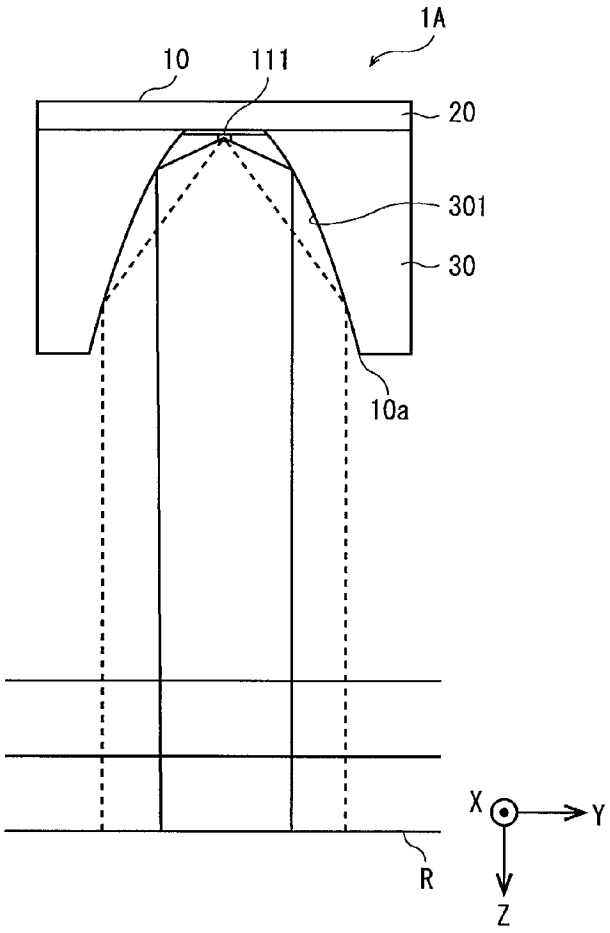
FIG. 4A and FIG. 4B are light beam diagrams of ultraviolet (UV) light emitted from an LED unit of a first embodiment.
Figure 4A:
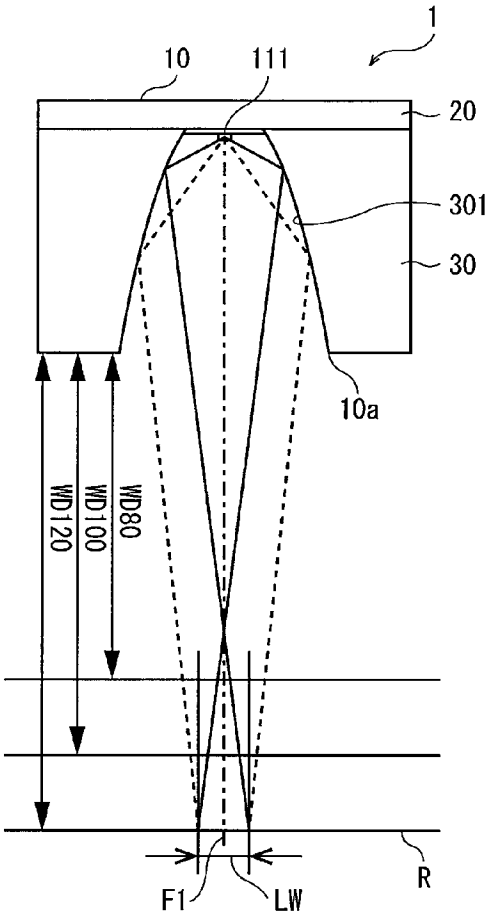

First, a first embodiment of a light illuminating apparatus of the present disclosure is described. FIG. 1 is a diagram showing an outward appearance of the light illuminating apparatus 1 according to the first embodiment of the present disclosure. The light illuminating apparatus 1 of this embodiment is an apparatus that is mounted in a printer (not shown) designed to perform a printing task by transferring an ink that is curable by ultraviolet (UV) light to a target object such as paper, and as described below, is disposed facing the target object and emits UV light of a line shape to the target object (FIG. 4A). As used herein, a lengthwise (line length) direction of UV light of a line shape emitted from the light illuminating apparatus 1 is defined as X-axis direction (first direction), a widthwise (line width) direction is defined as Y-axis direction (second direction), and a direction perpendicular to X axis and Y axis is defined as Z-axis direction (third direction). FIG. 1A is a front view of the light illuminating apparatus 1 when viewed from Y-axis direction. FIG. 1B is a bottom view of the light illuminating apparatus 1 when viewed from Z-axis direction (when viewed from the bottom of FIG. 1A to the top). FIG. 1C is a side view of the light illuminating apparatus 1 when viewed from X-axis direction (when viewed from the right side of FIG. 1A to the left side).

As shown in FIG. 1, the light illuminating apparatus 1 is equipped with a case 10, a base block 20, a mirror unit 30 and a light emitting diode (LED) unit 100. The case 10 is a case (housing) designed to receive the base block 20, the mirror unit 30 and the LED unit (a light emitting unit) 100, and has an opening 10*a* that is open in the lower surface (the lower surface of the light illuminating apparatus 1). Furthermore, the LED unit 100 is a unit designed to emit UV light of a line shape parallel to X-axis direction (as described in detail below).

The base block 20 is a support member for fixing the LED unit 100, and is formed from metal such as stainless steel. As shown in FIGS. 1B and C, the base block 20 is a member in the shape of an approximately rectangular plate that extends in X-axis direction. At the central part in widthwise direction (Y-axis direction) on the lower surface of the base block 20, the LED unit 100 extending in X-axis direction is disposed and fixedly attached by screw fixing or soldering.

Figure 2:
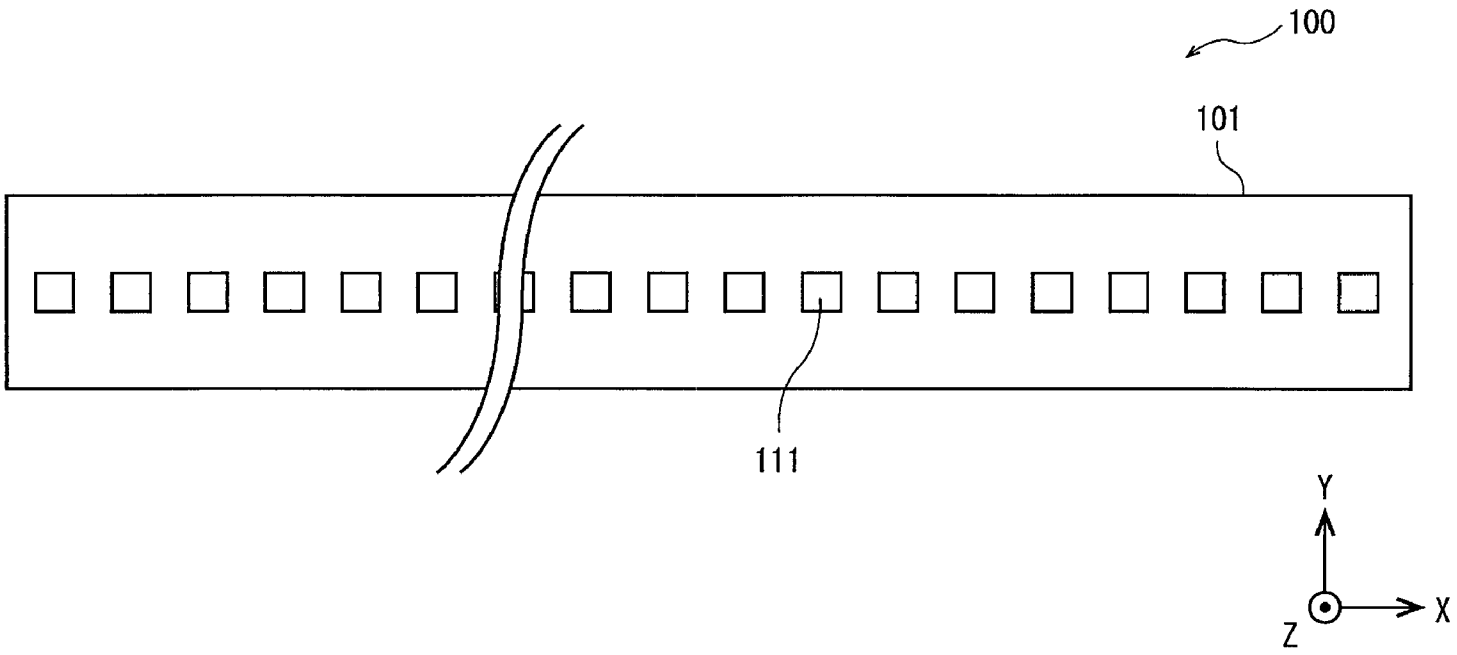
FIG. 2 is a diagram illustrating the configuration of a light emitting diode (LED) unit of a first embodiment.

FIG. 2 is a diagram illustrating the configuration of the LED unit 100 of the first embodiment, and shows the LED unit 100 when viewed from Z-axis direction. As shown in FIG. 2, the LED unit 100 is equipped with a substrate 101 of a rectangular shape that extends in X-axis direction, and 120 LED elements 111 (light sources) arranged at a predetermined interval along X-axis direction on the substrate 101. The plurality of LED elements 111 is disposed such that the direction of an optical axis is matched to Z-axis direction, and is electrically connected to the substrate 101. The substrate 101 of the LED unit 100 is connected to an LED driving circuit of the printer not shown, and each LED element 111 is supplied with a driving current from the LED driving circuit through the substrate 101. Each LED element 111 has an approximately square light emitting surface, and is supplied with the drive current from the LED driving circuit and emits UV light of a cure wavelength (for example, 365 nm, 385 nm, 395 nm, 405 nm) of the ink. As a result, UV light of a line shape parallel to the X axis is emitted from the LED unit 100. Additionally, each LED element 111 of this embodiment is supplied with a controlled driving current to emit an approximately uniform amount of UV light, and UV light of a line shape emitted from the LED unit 100 has an approximately uniform irradiation intensity distribution in X-axis direction (as described in detail below). Additionally, although FIG. 2 shows that the LED element 111 has one chip (dice), the LED element 111 may have a plurality of chips, for example, in an array of 2 (X-axis direction)×2 (Y-axis direction).

Additionally, the mirror unit 30 having a mirror surface 301 surrounding the LED element 111 is disposed on the substrate 101. The mirror unit 30 has a through-hole 31 that extends along X-axis direction and passes through in Z-axis direction. In an upper opening of the through-hole 31 (the base block 20 side), the LED element 111 is exposed to the through-hole 31, and a lower opening of the through-hole 31 is in communication with the opening 10*a* of the case 10. Additionally, the opening area of the through-hole 31 gradually increases as it goes downward, and the inner surface defining the through-hole 31 of the mirror unit 30 constitutes the mirror surface 301. The mirror unit 30 may be formed from metal such as aluminum, but the mirror surface 301 may be formed by installing a light reflective thin film on the inner surface defining the through-hole 31 of the mirror unit 30. After the UV light emitted from the LED unit 100 is reflected off the mirror surface 301, the UV light is focused and travels toward the target object through the opening 10*a*. Additionally, although this embodiment shows that two ends of the through-hole 31 in X-axis direction are covered with the walls of the case 10, they may be open.

Figure 3:
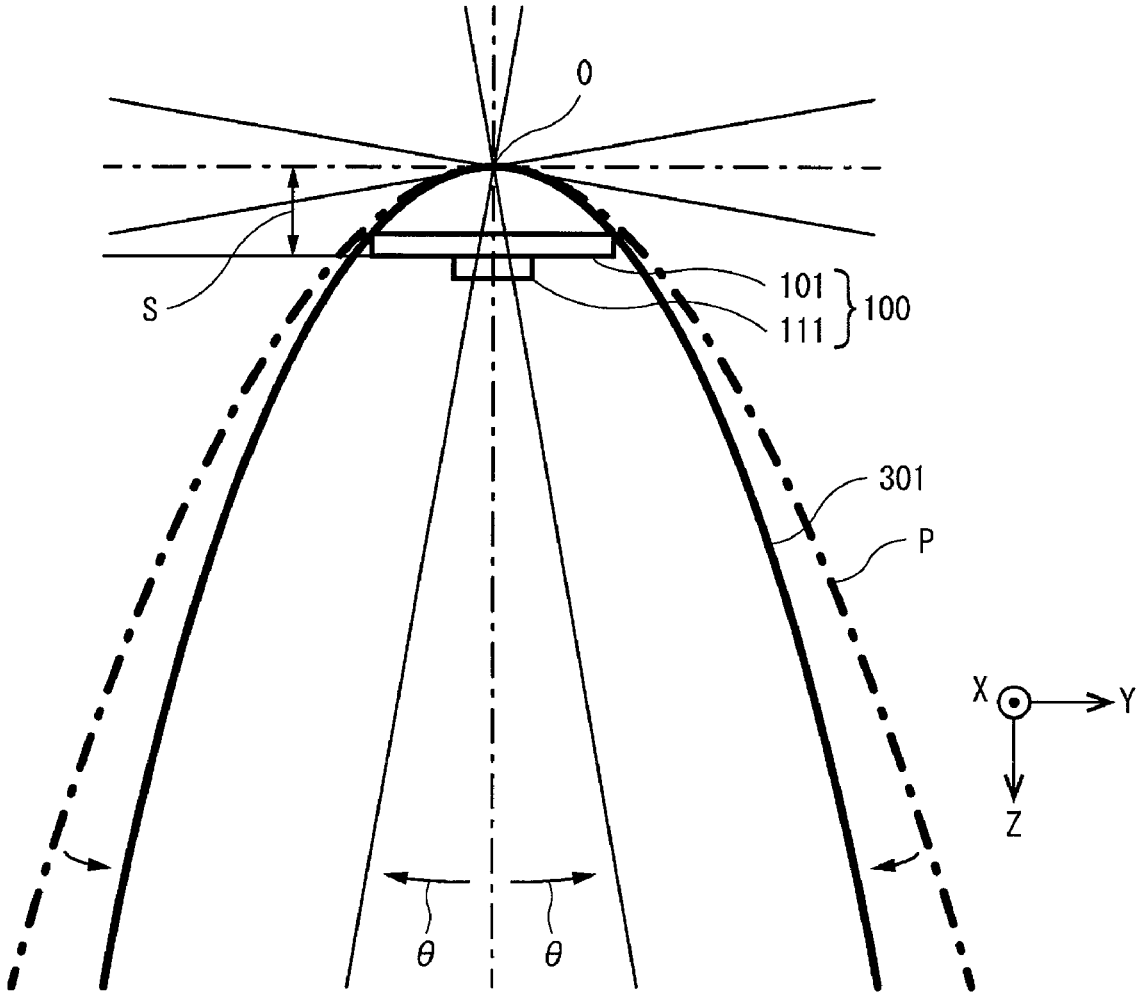
FIG. 3 is a diagram illustrating the feature of a cross-sectional shape of a mirror surface of a first embodiment.

The present disclosure is characterized in that the mirror surface 301 has a predetermined cross-sectional shape. FIG. 3 is a diagram illustrating the feature of the cross-sectional shape of the mirror surface 301 of the first embodiment. Additionally, FIG. 4 is a light beam diagram illustrating a light beam of UV light emitted from the light illuminating apparatus 1 of the first embodiment, FIG. 4A is a light beam diagram of UV light emitted from the light illuminating apparatus 1 of the first embodiment, and FIG. 4B is a light beam diagram of UV light emitted from the light illuminating apparatus 1A of comparative example. Additionally, in FIG. 4A, ⌜R⌟ denotes a reference irradiation surface to which the target object is conveyed, and an alternating long and short dash line indicates the optical axis AX of the LED unit 100. Additionally, ⌜F1⌟ denotes a reference irradiation position on the irradiation surface R where the optical axis AX meets, and ⌜LW⌟ denotes a line width of UV light at the reference irradiation position F1.

As shown in FIG. 3, in a cross section of the mirror unit 30 taken along the plane defined by Y-axis direction (second direction) and Z-axis direction (third direction), the cross-section shape of the mirror surface 301 is a curved shape resulting from rotation of each of a horizontal axis direction positive side part and a horizontal axis direction negative side part of a reference parabola $P(y=ax^2)$ in the coordinates where Y-axis direction (second direction) is the horizontal axis x and Z-axis direction (third direction) is the vertical axis y, around the origin O at the same rotation angle θ toward the vertical axis. As the cross-sectional shape of the mirror surface 301 is a curved shape as described above, after UV light emitted from the LED unit 100 is reflected off the mirror surface 301, the UV light is focused and irradiated on the irradiation surface R as shown in FIG. 4A. By focusing UV light on the irradiation surface, it is possible to set the irradiation intensity in Y-axis direction of UV light in the area of the line width LW to a predetermined value necessary for curing the ink (in this embodiment, about 2 $W/cm^2$) or above the predetermined value.

When the cross-sectional shape of the mirror surface 301 is a curved shape of the reference parabola P (i.e., a parabolic shape), after UV light emitted from the LED unit 100 is reflected off the mirror surface 301, the UV light is not focused and is irradiated on the irradiation surface R as an approximately parallel light as shown in FIG. 4B. For this reason, in the configuration of comparative example, without the expensive LED element 111 that emits high intensity of UV light, it is difficult to set the irradiation intensity in Y-axis direction to a predetermined value necessary for curing the ink or above the predetermined value.

The line width LW may be adjusted, for example, by setting the shape of the parabola P and the rotation angle θ around the origin O of the parabola P. Specifically, in the equation of the parabola $P:y=ax^2$, the coefficient a is preferably about 1-3, and more preferably about 1.5-2.5. Additionally, the rotation angle θ is preferably is about 3-10°, and more preferably about 6-8°. The adjusted line width LW is preferably about 10-30 mm (i.e., the range between about ±5 to 15 mm with respect to the reference irradiation position F1), and more preferably about 15-25 mm, and in this embodiment, is set to about 20 mm. Additionally, the area of the line length LL is an area in which the irradiation intensity in X-axis direction is a predetermined value necessary for curing the ink (in this embodiment, about 2 $W/cm^2$) or above the predetermined value. Additionally, the line length LL is properly set according on the size of the target object, and in this embodiment, is set to about 600 mm.

Additionally, as the cross-sectional shape of the mirror surface 301 is a curved shape as described above, it is possible to reduce the likelihood that a portion of UV light emitted from each LED element 111 will leak in a direction that does not contribute to the curing of the ink, thereby improving the irradiation intensity of UV light. From this viewpoint, each LED element 111 is preferably disposed at an offset position to the vertical axis positive side (i.e., Z-axis direction) from the origin of the parabola $P(y=ax^2)$. In this case, an offset quantity (indicated by ⌜S⌟ in FIG. 3) of each LED element 111 from the origin O is preferably about 3-7 mm, and more preferably about 4-6 mm. By disposing each LED element 111 at an offset position to the Z-axis positive side from the origin O, it is possible to efficiently extract most of UV light emitted from each LED element 111.

Furthermore, in the light illuminating apparatus 1 of this embodiment, the X-Y plane at the position 120 mm away in Z-axis direction from the edge of the case 10 (indicated by ⌜WD120⌟ in FIG. 4) is defined as the reference irradiation surface R, and the target object is conveyed along Y-axis direction on the reference irradiation surface R by a conveyor apparatus of the printer not shown. Accordingly, as the target object is sequentially conveyed on the reference irradiation surface R, UV light emitted from the LED unit 100 sequentially moves (scans) on the target object and sequentially cures (settles down) the ink on the target object. Furthermore, in this specification, the distance in Z-axis direction from the edge of the case 10 is referred to as a working distance WD of the light illuminating apparatus 1, and hereinafter, for example, the position at the working distance of 120 mm is referred to as ⌜WD120⌟.

As described above, UV light of a line shape emitted from the LED unit 100 is focused on the target object to settle down the ink on the target object. Here, from the viewpoint of the irradiation intensity of UV light necessary to settle down the ink, it is preferred to focus UV light of a line shape within a predetermined range on the target object. However, in many cases, the target object to be illuminated with UV light is paper, and often flutters during conveyance (i.e., varying position in Z-axis direction). As described above, if the position of the target object varies in Z-axis direction (i.e., if the target object does not pass through the reference irradiation surface R), UV light of a line shape is incident on the target object at the position different from a predetermined working distance, failing to irradiate a predetermined irradiation intensity of UV light on the target object. Furthermore, if the irradiation intensity of UV light does not reach the irradiation intensity necessary to settle down the ink, non-uniformity in the cured state of the ink occurs. Thus, as a result of a careful review, the inventor found out that when the cross-sectional shape of the mirror surface 301 is a predetermined curved shape (i.e., a curved shape resulting from rotation of each of the horizontal axis direction positive side part and the horizontal axis direction negative side part of the parabola $P(y=ax^2)$ around the origin O at the same rotation angle θ toward the vertical axis), and is configured to irradiate UV light with a predetermined irradiation width on the reference irradiation surface R, it is possible to obtain an approximately normal distribution of irradiation intensity in Y-axis direction of UV light of a line shape emitted from the LED unit 100, as well as desired irradiation intensity and irradiation intensity distribution of UV rays between predetermined working distances (for example, between WD80 and WD120), and completed the invention.

Figure 5A:
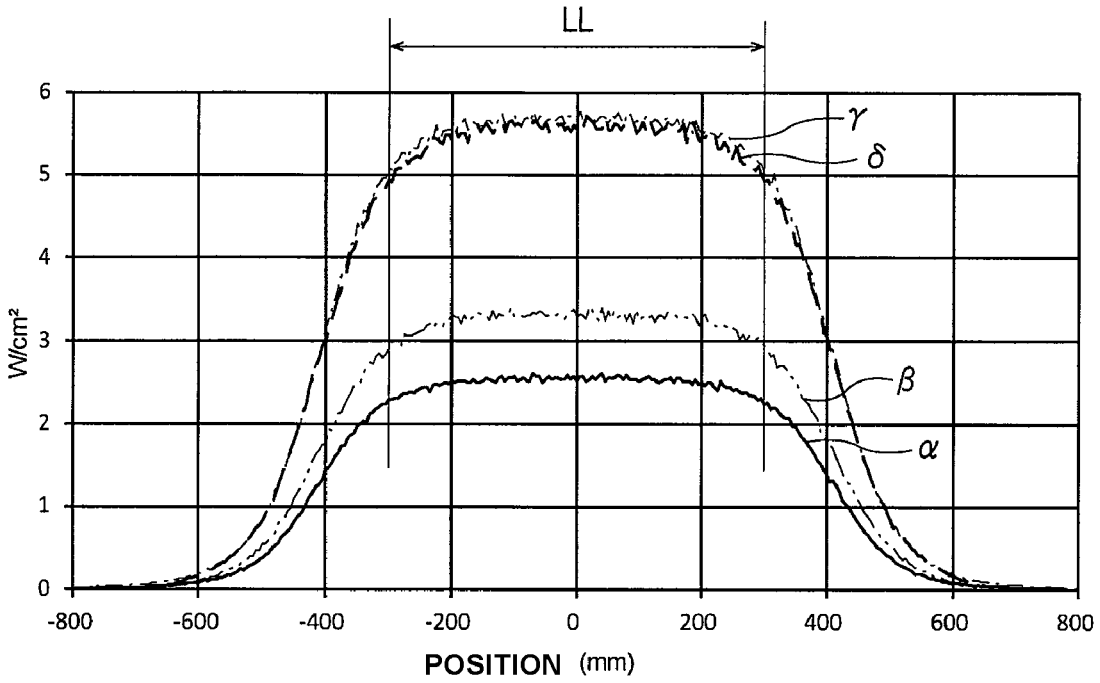
FIG. 5A and FIG. 5B are diagrams showing an irradiation intensity distribution at the position of WD120 of UV light emitted from a light illuminating apparatus according to each embodiment of the present disclosure.
Figure 5B:
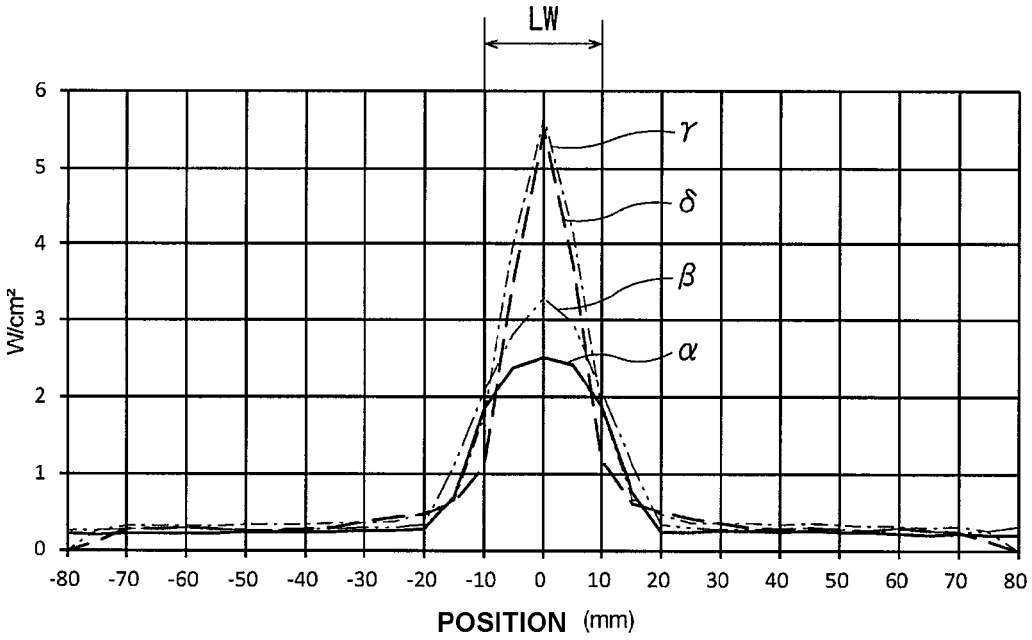
Figure 6A:
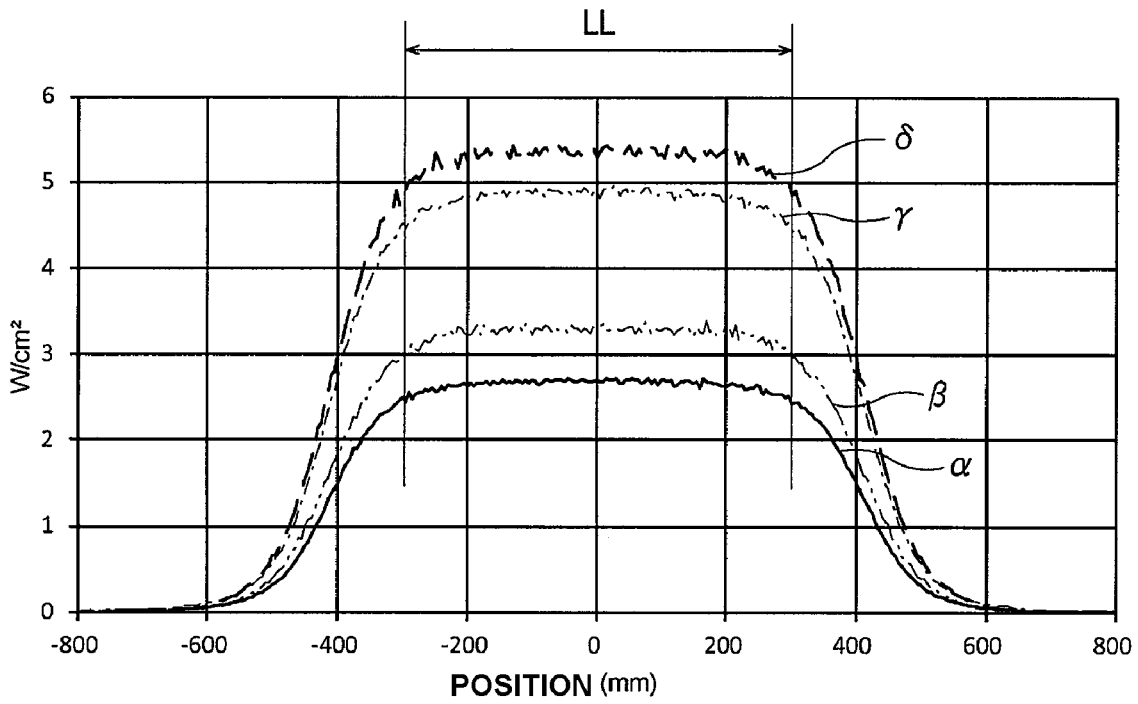
FIG. 6A and FIG. 6B are diagrams showing an irradiation intensity distribution at the position of WD100 of UV light emitted from a light illuminating apparatus according to each embodiment of the present disclosure.
Figure 6B:
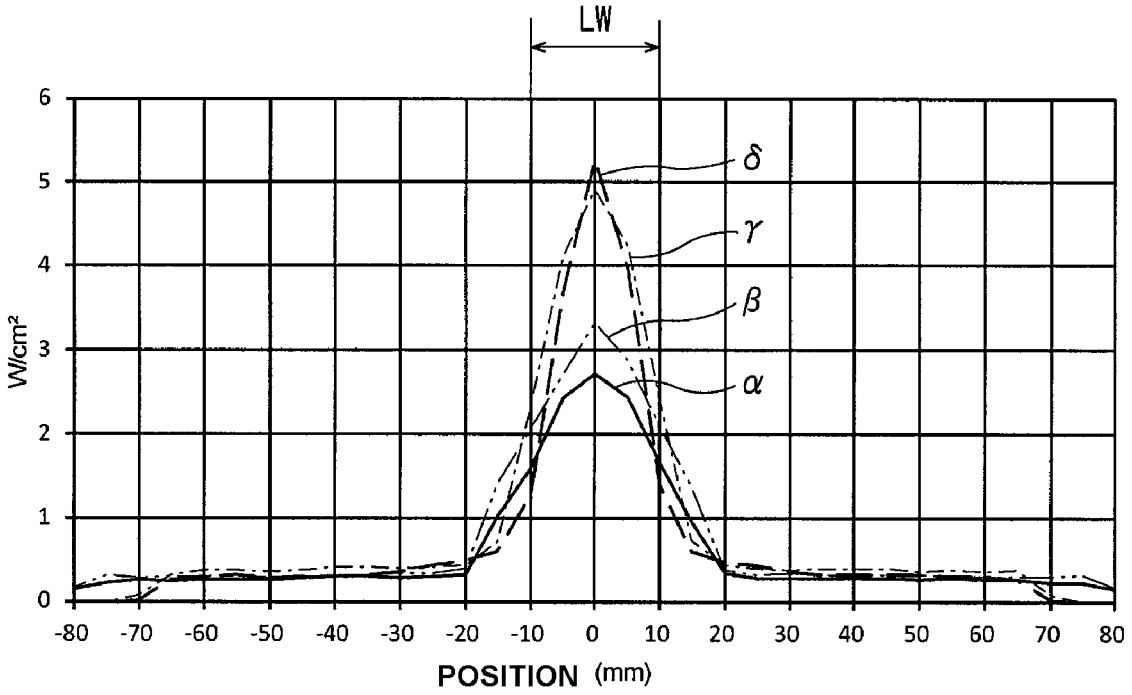
Figure 7A:
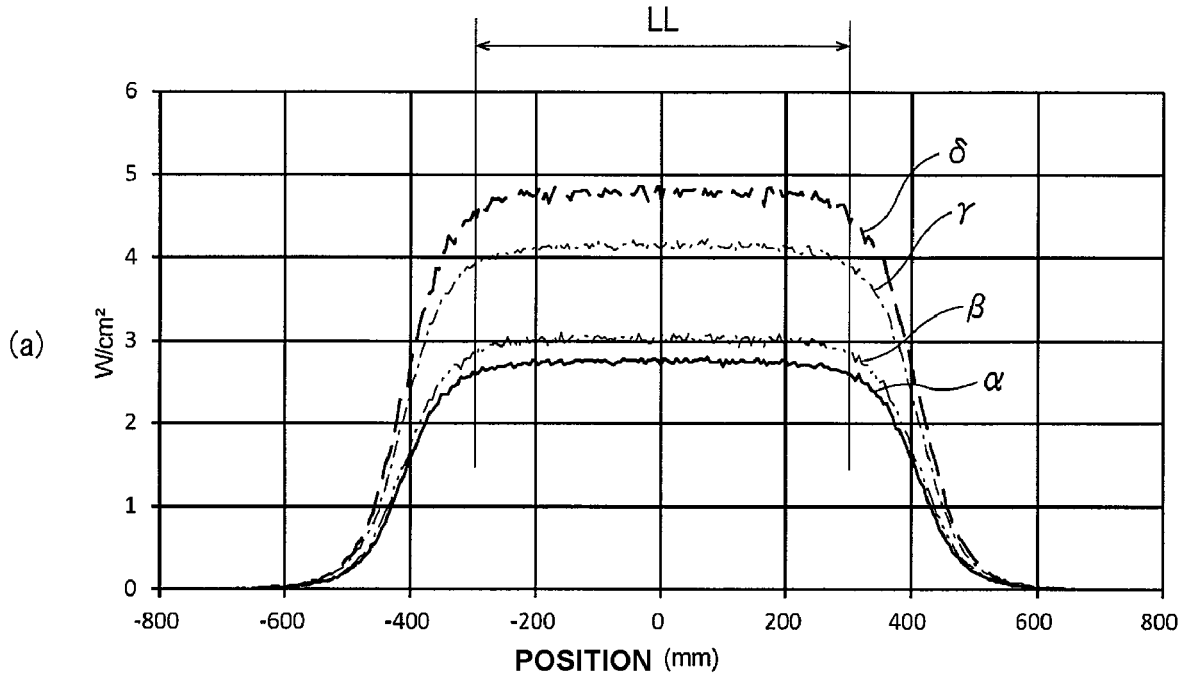
FIG. 7A and FIG. 7B are diagrams showing an irradiation intensity distribution at the position of WD80 of UV light emitted from a light illuminating apparatus according to each embodiment of the present disclosure.
Figure 7B:
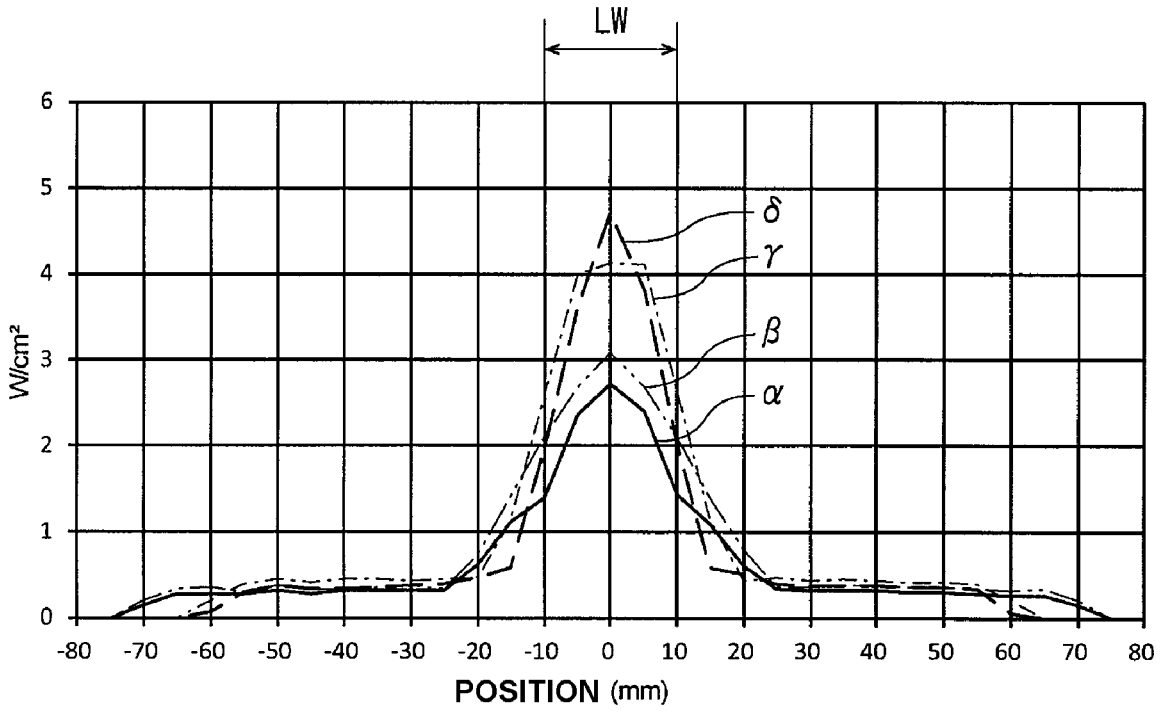

FIGS. 5 through 7 are diagrams showing the irradiation intensity distribution of UV light emitted from the light illuminating apparatus 1. FIG. 5 shows the irradiation intensity distribution of UV light at the position of WD120, FIG. 6 shows the irradiation intensity distribution of UV light at the position of WD100, and FIG. 7 shows the irradiation intensity distribution of UV light at the position of WD80. Furthermore, FIGS. 5A, 6A and 7A show the irradiation intensity distribution in X-axis direction at the position of the optical axis AX on the X-Y plane, in which the horizontal axis is the distance when the center in lengthwise direction of the light illuminating apparatus 1 (i.e., the position of ½ of the line length LL (length in X-axis direction) of UV light) is ⌜0 mm⌟, and the vertical axis is the irradiation intensity ($W/cm^2$) of UV light per unit area. Furthermore, FIGS. 5B, 6B and 7B show the irradiation intensity distribution in Y-axis direction at the center position in lengthwise direction of the light illuminating apparatus 1 on the X-Y plane (i.e., the position of ½ of the line length LL (length in X-axis direction) of UV light), in which the horizontal axis is the distance when the optical axis AX is ⌜0 mm⌟, and the vertical axis is the irradiation intensity ($W/cm^2$) of UV light per unit area. Furthermore, in FIGS. 5 to 7, ⌜α⌟ represents the irradiation intensity of UV light emitted from the light illuminating apparatus 1 of the first embodiment, ⌜β⌟ represents the irradiation intensity of UV light emitted from a light illuminating apparatus 2 of a second embodiment as described below, ⌜γ⌟ represents the irradiation intensity of UV light emitted from a light illuminating apparatus 3 of a third embodiment as described below, and ⌜δ⌟ represents the irradiation intensity of UV light emitted from a light illuminating apparatus 4 of a fourth embodiment as described below.

As shown in FIG. 5, because at the position of WD120, the irradiation intensity a of UV light is a predetermined value (about 2 $W/cm^2$) or more within the range of ±about 300 mm in X-axis direction (FIG. 5A), and a predetermined value (about 2 $W/cm^2$) or more within the range of ±about 10 mm in Y-axis direction (FIG. 5B). That is, at the position of WD100, UV light of a line shape is irradiated with the line length LL of about 600 mm and the line width LW of about 20 mm.

As shown in FIG. 6, because at the position of WD100, the distance from the edge of the case 10 to the irradiation surface is shorter, the irradiation width of UV light emitted from the LED unit 100 on the irradiation surface is slightly wider (FIG. 4A). However, as the irradiation intensity a of UV light is a predetermined value of (about 2 $W/cm^2$) or more within the range of ±about 300 mm in X-axis direction (FIG. 6A), and a predetermined value (about 2 $W/cm^2$) or more within the range of ±about 10 mm in Y-axis direction (FIG. 6B). That is, at the position of WD100, UV light of a line shape is irradiated with the line length LL of about 600 mm and the line width LW of about 20 mm. Furthermore, as shown in FIG. 6B, the irradiation intensity distribution of UV light emitted from the LED unit 100 in Y-axis direction have a slightly higher peak intensity than that of WD120.

As shown in FIG. 7, because at the position of WD80, the distance from the edge of the case 10 to the irradiation surface is much shorter, the irradiation width of UV light emitted from the LED unit 100 on the irradiation surface is much wider (FIG. 4A). However, the irradiation intensity a of UV light is a predetermined value (about 2 $W/cm^2$) or more within the range of ±about 300 mm in X-axis direction (FIG. 7A), and a predetermined value (about 2 $W/cm^2$) or more within the range of ±about 10 mm in Y-axis direction (FIG. 7B). That is, at the position of WD80, UV light of a line shape is irradiated with the line length LL of about 600 mm and the line width LW of about 20 mm. Furthermore, as shown in FIG. 7B, the irradiation intensity distribution of UV light emitted from the LED unit 100 in Y-axis direction have a much higher peak intensity than that of WD100.

As described above, in the light illuminating apparatus 1 of this embodiment, the cross-sectional shape of the mirror surface 301 is a predetermined curved shape (i.e., a curved shape resulting from rotation of each of the horizontal axis direction positive side part and the horizontal axis direction negative side part of the parabola $P(y=ax^2)$ around the origin O at the same rotation angle θ toward the vertical axis), and is configured to irradiate UV light with a predetermined irradiation width on the reference irradiation surface R, thereby obtaining an approximately normal distribution of irradiation intensity in Y-axis direction of UV light of a line shape emitted from the LED unit 100, as well as desired irradiation intensity and irradiation intensity distribution of UV rays within the range of WD80-WD120. That is, because the irradiation intensity distribution of UV light emitted from the light illuminating apparatus 1 is approximately uniform within the range of WD80-WD120, even though the target object (for example, paper) to be illuminated with UV light flutters within the range of WD80-WD120, the irradiation intensity of UV light necessary to settle down the ink can be uniformly irradiated on the target object, and the cured state of the ink is stable (i.e., non-uniformity in the cured state does not occur).

Figure 8C:
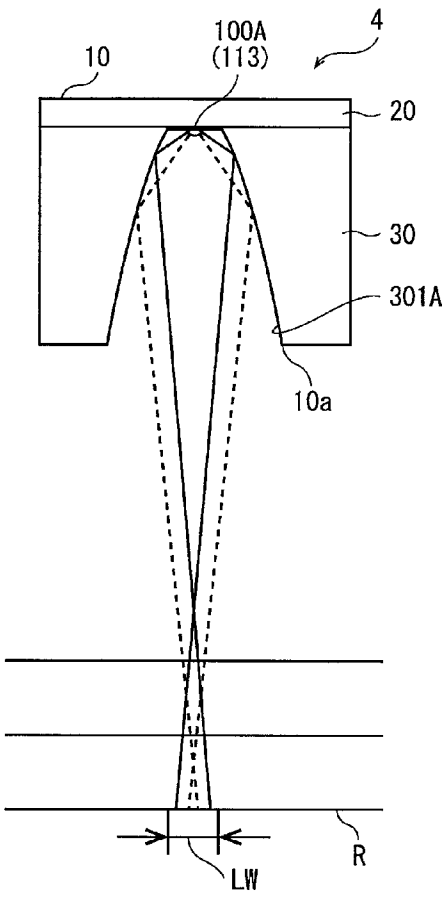
FIG. 8A, FIG. 8B, and FIG. 8C are light beam diagrams of UV light emitted from light illuminating apparatuses of second to fourth embodiments.
Figure 8B:
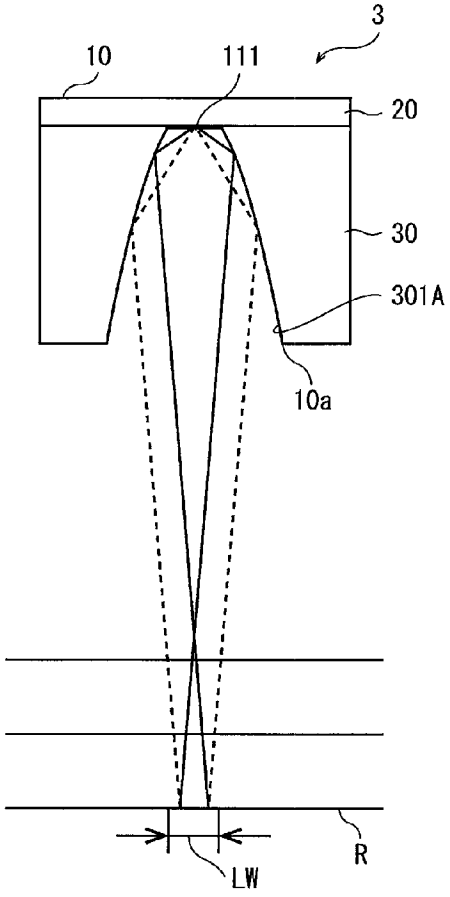

Subsequently, the second to fourth embodiments of the light illuminating apparatus of the present disclosure are described with reference to FIG. 8. Hereinafter, the second to fourth embodiments are described based on differences from the first embodiment, and the same description is omitted herein. FIG. 8 is a light beam diagram of UV light emitted from light illuminating apparatuses 2-4 of the second to fourth embodiments.

(Second Embodiment)

Figure 8A:
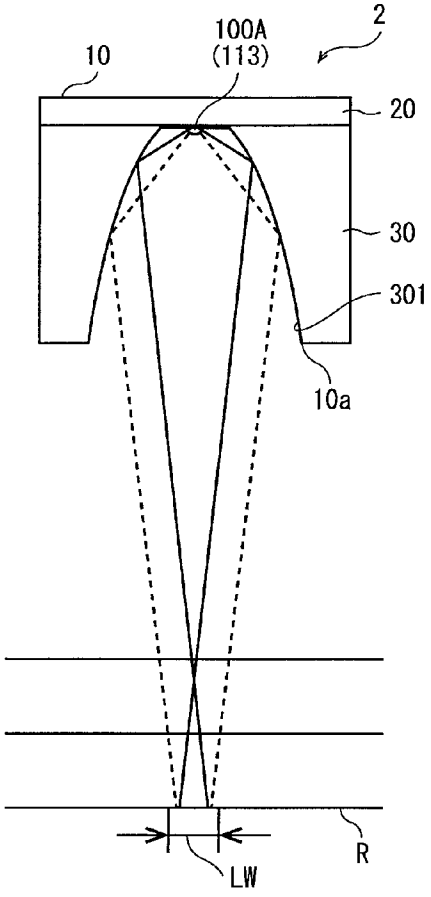

The second embodiment is the same as the first embodiment except that the configuration of an LED unit 100A is different. That is, the LED unit 100A of the light illuminating apparatus 2 of the second embodiment has an encapsulation lens 113 disposed on the substrate 101, covering each LED element 111, as shown in FIG. 8A. The encapsulation lens 113 is a cannon-shaped or hemispherical member formed from, for example, optical glass or light transmitting resin (silicone resin), and is placed in close contact with the surface of the LED element 111 and serves to encapsulate the LED element 111 and shape incident UV light diffused from the LED element 111 into light of a predetermined divergence angle, to increase the UV light extraction efficiency. Additionally, in FIGS. 5 to 7, ⌜β⌟ represents the irradiation intensity of UV light emitted from the light illuminating apparatus 1 of the second embodiment.

In the light illuminating apparatus 2 of the second embodiment, as shown in FIGS. 5 to 7, at any position of WD80-WD120, the irradiation intensity β of UV light is a predetermined value (about 2 $W/cm^2$) or more within the range of ±about 300 mm in X-axis direction (FIGS. 5A to 7A), and a predetermined value (about 2 $W/cm^2$) or more within the range of ±about 10 mm in Y-axis direction (FIGS. 5B to 7B). That is, at any position of WD80-WD120, UV light of a line shape is irradiated with the line length LL of about 600 mm and the line width LW of about 20 mm. Additionally, because in the second embodiment, UV light extraction efficiency is improved by the presence of the encapsulation lens 113, the irradiation intensity β of UV light is higher than the irradiation intensity a of UV light of the first embodiment.

(Third Embodiment)

Figure 9:
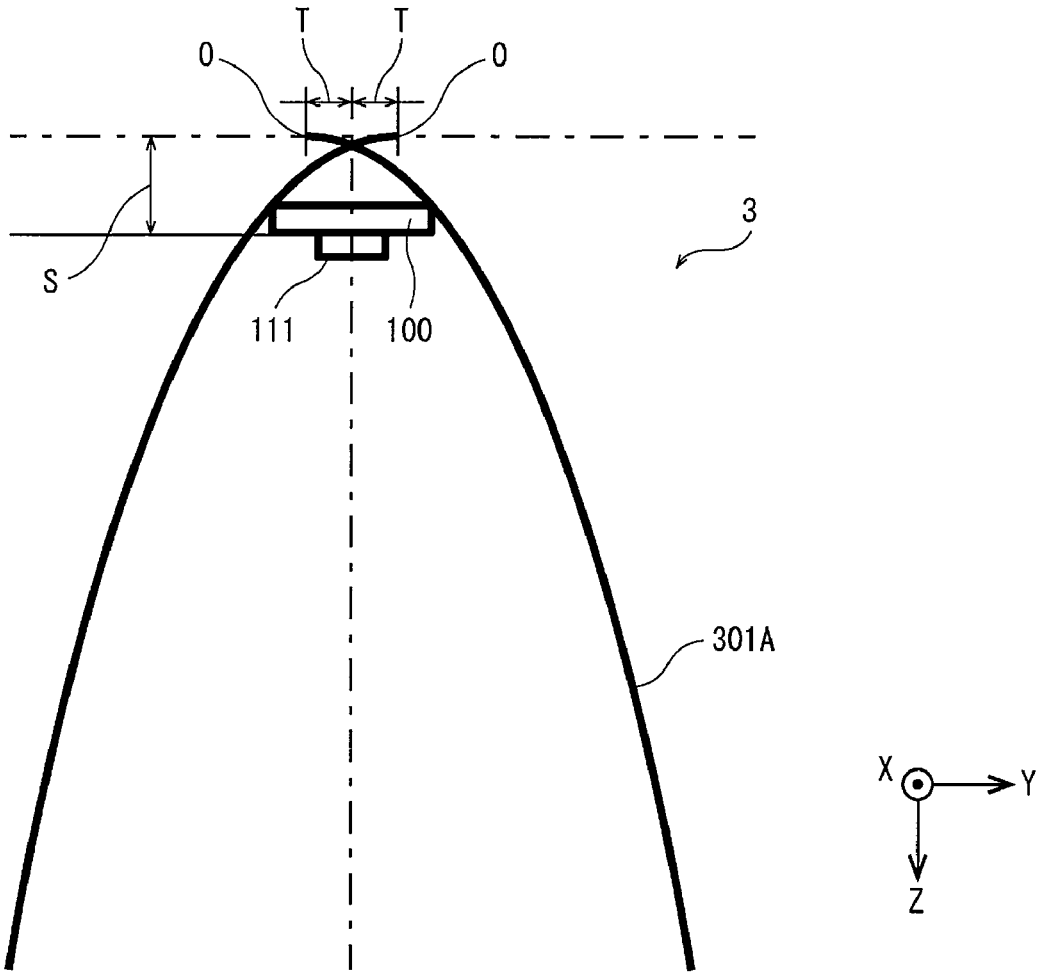
FIG. 9 is a diagram illustrating the feature of a cross-sectional shape of a mirror surface of a third embodiment.

The third embodiment is the same as the first embodiment except that the cross-sectional shape of a mirror surface 301A is different. FIG. 9 is a diagram illustrating the feature of the cross-sectional shape of the mirror surface 301A of the third embodiment. That is, in the light illuminating apparatus 3 of the third embodiment, the mirror surface 301A is in a shape resulting from movement of each of the horizontal axis direction positive side part and the horizontal axis direction negative side part of the mirror surface 301 (the reference parabola P after rotation) of the first embodiment to the horizontal axis (Y-axis direction) side as much as a predetermined distance T along the horizontal axis (Y-axis direction). Because according to the mirror surface 301A of the third embodiment, UV light can be focused in a narrower area on the irradiation surface, the irradiation intensity in Y-axis direction of UV light in the area of the line width LW is higher. Additionally, the predetermined distance T is preferably about 0.5-4 mm, and more preferably about 1-3 mm. By this, it is possible to precisely focus UV light in a narrower area on the irradiation surface. Additionally, in FIGS. 5 to 7, ⌜γ⌟ represents the irradiation intensity of UV light emitted from the light illuminating apparatus 1 of the third embodiment.

In the light illuminating apparatus 3 of the third embodiment, as shown in FIGS. 5 to 7, at any position of WD80-WD120, the irradiation intensity γ of UV light is a predetermined value (about 2 W/cm$^2$) or more within the range of ±about 300 mm in X-axis direction (FIGS. 5A to 7A), and a predetermined value (about 2 W/cm$^2$) or more within the range of ±about 10 mm in Y-axis direction (FIGS. 5B to 7B). That is, at any position of WD80-WD120, UV light of a line shape is irradiated with the line length LL of about 600 mm and the line width LW of about 20 mm. Additionally, because in the third embodiment, UV light is focused in a narrower area on the irradiation surface, the irradiation intensity γ of UV light is much higher than the irradiation intensity α of UV light of the first embodiment.

(Fourth Embodiment)

The fourth embodiment is the same as the first embodiment except that the configuration of an LED unit 100A and the cross-sectional shape of a mirror surface 301A are different. That is, in the light illuminating apparatus 4 of the fourth embodiment, each LED element 111 is covered with the encapsulation lens 113 in the same way as the second embodiment, and has the mirror surface 301A in the same way as the third embodiment. Accordingly, the light illuminating apparatus 4 of the fourth embodiment has higher UV light extraction efficiency than the light illuminating apparatus 1 of the third embodiment. Additionally, in FIGS. 5 to 7, ⌜δ⌟ represents the irradiation intensity of UV light emitted from the light illuminating apparatus 1 of the fourth embodiment.

In the light illuminating apparatus 4 of the fourth embodiment, as shown in FIGS. 5 to 7, at any position of WD80-WD120, the irradiation intensity γ of UV light is a predetermined value (about 2 W/cm$^2$) or more within the range of ±about 300 mm in X-axis direction (FIGS. 5A to 7A), and a predetermined value (about 2 W/cm$^2$) or more within the range of ±about 10 mm in Y-axis direction (FIGS. 5B to 7B). That is, at any position of WD80-WD120, UV light of a line shape is irradiated with the line length LL of about 600 mm and the line width LW of about 20 mm. Additionally, in the fourth embodiment, the irradiation intensity distribution of UV light emitted from the LED unit 100A has slightly higher peak intensity than the third embodiment.

While each embodiment of the present disclosure has been hereinabove described, the present disclosure is not limited to the foregoing configuration, and various modifications may be made within the scope of the technical spirit of the present disclosure.

For example, although each embodiment is configured to irradiate uniform UV light within the range of WD80-WD120 under the condition in which the position of WD120 is the reference irradiation surface R and the flutter range of the target object, paper, is the range of WD80-WD120, the range of working distance is not limited thereto and may be appropriately changed depending on the specification.

Furthermore, although the plurality of LED elements 111 is arranged in a row along X-axis direction on the substrate 101, the present disclosure is not limited thereto, and a plurality of the rows may be installed along Y-axis direction.

Furthermore, although the light illuminating apparatus 1 of this embodiment is an apparatus that is mounted in the printer designed to perform a printing task by transferring an ink that is curable by UV light to the target object such as paper, the light illuminating apparatus 1 may be used in other applications, for example, mandrel UV curing equipment, etc.

Furthermore, it should be understood that the disclosed embodiments are illustrative in all aspects and are not limitative. The scope of the present disclosure is defined by the appended claims rather than the foregoing description, and is intended to cover all changes within the claims and the equivalent meaning and scope.

DETAILED DESCRIPTION OF MAIN ELEMENTS

1, 2, 3, 4: Light illuminating apparatus
1A: Light illuminating apparatus (comparative example)
10: Case
10*a*: Opening
20: Base block
30: Mirror unit
301, 301A: Mirror surface
31: Through-hole
100, 100A: LED unit
111: LED element
113: Encapsulation lens

The invention claimed is:

1. A light illuminating apparatus for irradiating, to a predetermined irradiation position on a reference irradiation surface, light of a line shape extending in a first direction, parallel to a first axis x, and having a predetermined line width in a second direction perpendicular to the first direction, the second direction parallel to a second axis y, the light illuminating apparatus comprising:

a light emitting unit comprising a substrate, and a plurality of light sources arranged at a predetermined interval along the first direction on the substrate such that a direction of an optical axis is a third direction perpendicular to the first direction and the second direction, the third direction parallel to a third axis defined as a z axis; and a mirror unit having a mirror surface to reflect and focus the light irradiated from the light emitting unit, wherein a cross section of the mirror unit taken along a plane defined by the second direction and the third direction is defined relative to a shape of a reference parabola $z=ay^2$ (a is coefficient) having an origin O, wherein the z axis passes through the origin O, a first side of the mirror unit on a positive side of the origin O rotated, relative to the reference parabola, toward the z axis around the origin O by a rotation angle θ, and a second side of the mirror unit on a negative side of the origin O rotated, relative to the reference parabola, toward the z axis around the origin O by the rotation angle θ, wherein the coefficient a of the parabola is in a range from 1-3.

2. The light illuminating apparatus according to claim 1, wherein the rotation angle θ is in a range from 3-10°.

3. The light illuminating apparatus according to claim 1, wherein the first side of the mirror unit and the second side of the mirror unit are spaced apart from each other such that, relative to the reference parabola, the first side of the mirror unit is moved in a translational manner toward the z axis after the rotation around the origin O, and the second side of the mirror unit is moved in the translational manner toward the z axis after the rotation around the origin O.

4. The light illuminating apparatus according to claim 3, wherein a movement distance of each of the first side of the mirror unit and the second side of the mirror unit, after the rotation to the vertical axis side, is 0.5-4 mm.

5. The light illuminating apparatus according to claim 1, wherein the light source is disposed at an offset position in the third direction from the origin.

6. The light illuminating apparatus according to claim 5, wherein an offset quantity of the light source from the origin is in a range from 3-7 mm.

7. The light illuminating apparatus according to claim 1, wherein the light emitting unit has an encapsulation lens disposed on the substrate, covering each light source.

8. The light illuminating apparatus according to claim 1, wherein the light is light of a wavelength that acts on an ultraviolet curable resin.

9. The light illuminating apparatus according to claim 1, wherein the rotation angle θ is in a range from 3-10°.

10. The light illuminating apparatus according to claim 1, wherein the first side of the mirror unit and the second side of the mirror unit are spaced apart from each other such that, relative to the reference parabola, the first side of the mirror unit is moved in a translational manner toward the z axis after the rotation around the origin O, and the second side of the mirror unit is moved in the translational manner toward the z axis after the rotation around the origin.

11. The light illuminating apparatus according to claim 2, wherein the first side of the mirror unit and the second side of the mirror unit are spaced apart from each other such that, relative to the reference parabola, the first side of the mirror unit is moved in a translational manner toward the z axis after the rotation around the origin O, and the second side of the mirror unit is moved in the translational manner toward the z axis after the rotation around the origin O.

12. The light illuminating apparatus according to claim 9, wherein the first side of the mirror unit and the second side of the mirror unit are spaced apart from each other such that, relative to the reference parabola, the first side of the mirror unit is moved in a translational manner toward the z axis after the rotation around the origin O, and the second side of the mirror unit is moved in the translational manner toward the z axis after the rotation around the origin O.

13. The light illuminating apparatus according to claim 10, wherein a movement distance of each of the first side of the mirror unit and the second side of the mirror unit, after the rotation to the vertical axis side, is 0.5-4 mm.

14. The light illuminating apparatus according to claim 11, wherein a movement distance of each of the first side of the mirror unit and the second side of the mirror unit, after the rotation to the vertical axis side, is 0.5-4 mm.

15. The light illuminating apparatus according to claim 12, wherein a movement distance of each of the first side of the mirror unit and the second side of the mirror unit, after the rotation to the vertical axis side, is 0.5-4 mm.

16. A light illuminating apparatus for irradiating, to a predetermined irradiation position on a reference irradiation surface, light of a line shape extending in a first direction, parallel to a first axis x, and having a predetermined line width in a second direction perpendicular to the first direction, the second direction parallel to a second axis y, the light illuminating apparatus comprising:

a light emitting unit comprising a substrate, and a plurality of light sources arranged at a predetermined interval along the first direction on the substrate such that a direction of an optical axis is a third direction perpendicular to the first direction and the second direction, the third direction parallel to a third axis defined as a z axis; and a mirror unit having a mirror surface to reflect and focus the light irradiated from the light emitting unit, wherein a cross section of the mirror unit taken along a plane defined by the second direction and the third direction is defined relative to a shape of a reference parabola $z=ay^2$ (a is coefficient) having an origin O, wherein the z axis passes through the origin O, a first side of the mirror unit on a positive side of the origin O rotated, relative to the reference parabola, toward the z axis around the origin O by a rotation angle θ, and a second side of the mirror unit on a negative side of the origin O rotated, relative to the reference parabola, toward the z axis around the origin O by the rotation angle θ, wherein the rotation angle θ is in a range from 3-10°.

17. A light illuminating apparatus for irradiating, to a predetermined irradiation position on a reference irradiation surface, light of a line shape extending in a first direction, parallel to a first axis x, and having a predetermined line width in a second direction perpendicular to the first direction, the second direction parallel to a second axis y, the light illuminating apparatus comprising:

a light emitting unit comprising a substrate, and a plurality of light sources arranged at a predetermined interval along the first direction on the substrate such that a direction of an optical axis is a third direction perpendicular to the first direction and the second direction, the third direction parallel to a third axis defined as a z axis; and a mirror unit having a mirror surface to reflect and focus the light irradiated from the light emitting unit, wherein a cross section of the mirror unit taken along a plane defined by the second direction and the third direction is defined relative to a shape of a reference parabola z=ay2 (a is coefficient) having an origin O, wherein the z axis passes through the origin O, a first side of the mirror unit on a positive side of the origin O rotated, relative to the reference parabola, toward the z axis around the origin O by a rotation angle θ, and a second side of the mirror unit on a negative side of the origin O rotated, relative to the reference parabola, toward the z axis around the origin O by the rotation angle θ, wherein the first side of the mirror unit and the second side of the mirror unit are spaced apart from each other such that, relative to the reference parabola, the first side of the mirror unit is moved in a translational manner toward the z axis after the rotation around the origin O, and the second side of the mirror unit is moved in the translational manner toward the z axis after the rotation around the origin O, and wherein a movement distance of each of the first side of the mirror unit and the second side of the mirror unit, after the rotation to the vertical axis side, is 0.5-4 mm.

18. A light illuminating apparatus for irradiating, to a predetermined irradiation position on a reference irradiation surface, light of a line shape extending in a first direction, parallel to a first axis x, and having a predetermined line width in a second direction perpendicular to the first direction, the second direction parallel to a second axis y, the light illuminating apparatus comprising:

a light emitting unit comprising a substrate, and a plurality of light sources arranged at a predetermined interval along the first direction on the substrate such that a direction of an optical axis is a third direction perpendicular to the first direction and the second direction, the third direction parallel to a third axis defined as a z axis; and a mirror unit having a mirror surface to reflect and focus the light irradiated from the light emitting unit, wherein a cross section of the mirror unit taken along a plane defined by the second direction and the third direction is defined relative to a shape of a reference parabola $z=ay^2$ (a is coefficient) having an origin O, wherein the z axis passes through the origin O, a first side of the mirror unit on a positive side of the origin O rotated, relative to the reference parabola, toward the z axis around the origin O by a rotation angle θ, and a second side of the mirror unit on a negative side of the origin O rotated, relative to the reference parabola, toward the z axis around the origin O by the rotation angle θ, wherein the light source is disposed at an offset position in the third direction from the origin, and wherein an offset quantity of the light source from the origin is in a range from 3-7 mm.

* * * * *